US006203140B1

(12) United States Patent
Oyen

(10) Patent No.: US 6,203,140 B1
(45) Date of Patent: Mar. 20, 2001

(54) METHOD OF COMPENSATING FOR THE FAILURE OF A DOT GENERATING UNIT IN A PRINTING SYSTEM

(75) Inventor: Johannes P. H. Oyen, Roermond (NL)

(73) Assignee: OCE-Technologies B.V., Ma Venlo (NL)

( * ) Notice: Subject to any disclaimer, the term of this patent is extended or adjusted under 35 U.S.C. 154(b) by 0 days.

(21) Appl. No.: 09/374,985

(22) Filed: Aug. 16, 1999

(30) Foreign Application Priority Data

Aug. 17, 1998 (EP) ..... 98202785

(51) Int. Cl.[7] ..... B41J 2/145; B41J 2/15; B41J 29/38; B41J 29/393

(52) U.S. Cl. ..... 347/41; 347/9; 347/19

(58) Field of Search ..... 347/43, 19, 41, 347/9

(56) References Cited

U.S. PATENT DOCUMENTS

| | | | | |
|---|---|---|---|---|
| 4,498,088 | | 2/1985 | Kanayama | 347/43 |
| 5,359,355 | | 10/1994 | Nagoshi et al. | 347/43 |
| 5,675,365 | * | 10/1997 | Becerra et al. | 347/9 |
| 5,796,418 | * | 8/1998 | Silverbrook | 347/55 |

FOREIGN PATENT DOCUMENTS

| | | |
|---|---|---|
| 0616893A2 | 9/1994 | (EP) . |
| 0677390A1 | 10/1995 | (EP) . |
| 0694396A2 | 1/1996 | (EP) . |
| 0729838A1 | 9/1996 | (EP) . |
| 0783973A2 | 7/1997 | (EP) . |
| 60-104335 | 6/1995 | (JP) . |

* cited by examiner

*Primary Examiner*—Thinh Nguyen
(74) *Attorney, Agent, or Firm*—Birch, Stewart, Kolasch & Birch, LLP

(57) ABSTRACT

A method of compensating for the failure of a dot generating unit in a printing system including a multiple-unit printhead scanning an image receiving medium in line direction and capable of printing several lines at a time, wherein multi-pass printing and interleaved line feed are employed, and wherein when a unit fails, the image information associated with that unit for each pass of the printhead is printed with at least one other unit of the printhead during at least one of the other passes and wherein two-pass printing is performed.

3 Claims, 2 Drawing Sheets

METHOD OF COMPENSATING FOR THE FAILURE OF A DOT GENERATING UNIT IN A PRINTING SYSTEM

BACKGROUND OF THE INVENTION

The present invention relates to a method of compensating for the failure of a dot generating unit in a printing system including a multiple-unit printhead scanning an image receiving medium in line direction and capable of printing several lines at a time, wherein multi-pass printing and interleaved line feed are employed and wherein as a unit fails the image information associated with that unit for each pass of the printhead is printed with at least one other unit of the printhead during at least one of the other passes.

A multiple-unit printhead comprises a plurality of dot generating units arranged in an array which extends perpendicular to the direction of the printing lines on the image receiving medium. Thus, image dots can be printed simultaneously in a plurality of lines, while the printhead performs a single scanning stroke or pass across the image receiving medium. For example, in the case of an ink jet printer, each dot generating unit is formed by a single nozzle and an associated actuator system by which ink droplets are jetted out from the nozzle in response to a drop demand signal supplied thereto in accordance with the image information to be printed.

Multi-pass printing means that only part of the image information is printed in a single pass of the printhead, i.e. during the movement of the printhead in a unique direction over the entire length of the line, and the printed line is completed in one or more subsequent passes. For example, in case of a two-pass system, every second dot or pixel is printed during the forward pass of the printhead and the missing dots are inserted during the second pass.

Interleaved line feed means that at least two different units or nozzles of the printhead contribute to the printing of each image line. This is achieved by feeding the image recording medium in a direction normal to the image lines in steps that have a width smaller than the extension of the nozzle array in that direction, so that the nozzle array sweeps at least twice over each location on the receiving medium.

An example of a printing system with the above features is disclosed in US-A-5,359,355. When, in this system, one of the dot generating units of the printhead becomes inoperative, e.g. because the nozzle has become clogged or air is trapped in the actuator system, the image information can not be printed completely. If, for example, the printhead has eight nozzles and one of them is inoperative, then, in a single-pass system or a system in which no interleaved line feed is employed, every eighth line will be missing on the printed document. In the case of a two-pass system with interleaved line feed, every second dot or pixel will be missing in every fourth line.

JP-A-60-104 335 discloses an ink jet printer, in which additional nozzles are provided in reserve on the printhead. If one of the regular nozzles fails, the printing pattern is changed, so that one or more of the reserve nozzles are activated in order to compensate for the failure. In this system, however, the number of usable nozzles is always limited to the maximal number of consecutive nozzles in the array that are operative. As a result, a certain loss of production of the printer must generally be expected, depending on the location where the nozzle failure occurs.

SUMMARY OF THE INVENTION

It is an object of the present invention to provide a method for compensating failure of a dot generating unit with minimised losses in image quality and production.

According to the present invention, when n is the number of passes per scan cycle, the unit which prints also the image information associated with the inoperative unit is operated with n times the operating frequency of the other units, and the printhead is moved in the scanning direction with the same speed as in the case where all units are operative.

Thus, when an individual nozzle becomes inoperative, the task of this nozzle is taken over by one of the other regular nozzles of the printhead. It is accordingly not necessary to provide spare nozzles on the printhead, so that a cost reduction can be realised. Most importantly, however, the failure of the nozzle does not lead to a reduced productivity of the printer because the image information that normally had to be printed by the inoperative nozzle is printed during one of the other passes that would have been performed anyway. Thus, if the printhead has eight nozzles for example, and one of these nozzles becomes clogged, the printing process can be continued with printing the full image information of eight lines in each multi-pass cycle, and it is not necessary to perform any extra scan passes.

It will be understood that the nozzle or nozzles that have to take over the task of the inoperative nozzle will be required to generate more dots than during normal operation. This means that either the scanning speed of the printhead must be reduced or the nozzle must be capable of generating dots at a higher frequency than under normal conditions. However, with existing printheads, e.g. ink jet printheads with piezoelectric actuators, it is generally possible to increase the operating frequency of a few of the nozzles without causing a significant loss of image quality. The reason is that the upper limit for the operating frequency of the dot generating units of a multiple-unit printhead is generally imposed by cross-talk among the various units. For example, in case of an ink jet printhead with piezoelectric actuators, the printhead has to absorb reaction forces caused by the piezoelectric actuators, and this leads to a certain noise which adversely influences the performance of the neighbouring nozzles. However, this phenomenon becomes significant only when almost all of the nozzles operate at a high frequency. When only one or two out of the plurality of nozzles are operated at a higher frequency, as is the case in the present invention, then the cross-talk effects are generally tolerable. Thus, it is possible according to the present invention to compensate for the failure of one or a few nozzles of the printhead by increasing the operating frequency of some of the other nozzles, so that the printing speed need not be reduced and, nevertheless, the printed image will have a satisfactory quality.

As a result, the present invention permits the maintenance intervals for the printer to be significantly extended, especially for a color printer in which the likelihood of nozzle failure is multiplied because one printhead must be provided for each color.

In a preferred embodiment, the function of the dot generating units is automatically checked at regular intervals, for example after each scan cycle or after a certain number of scan cycles, and when it has been detected that an individual unit has become inoperative, the compensation procedure according to the present invention is initiated automatically by appropriately changing the timing in which the units are activated and the pattern in which the image information is supplied thereto. This function can easily be implemented in the control software of the printer and can be initiated "on the fly", i.e. without interrupting the operation of the printer.

An example of a system for automatically detecting the failure of a nozzle in an ink jet printer is disclosed in US-A-4,498,088.

BRIEF DESCRIPTION OF THE DRAWINGS

Preferred embodiments of the present invention will now be described in conjunction with the accompanying drawings, wherein.

DETAILED DESCRIPTION OF THE INVENTION

Figure 1:
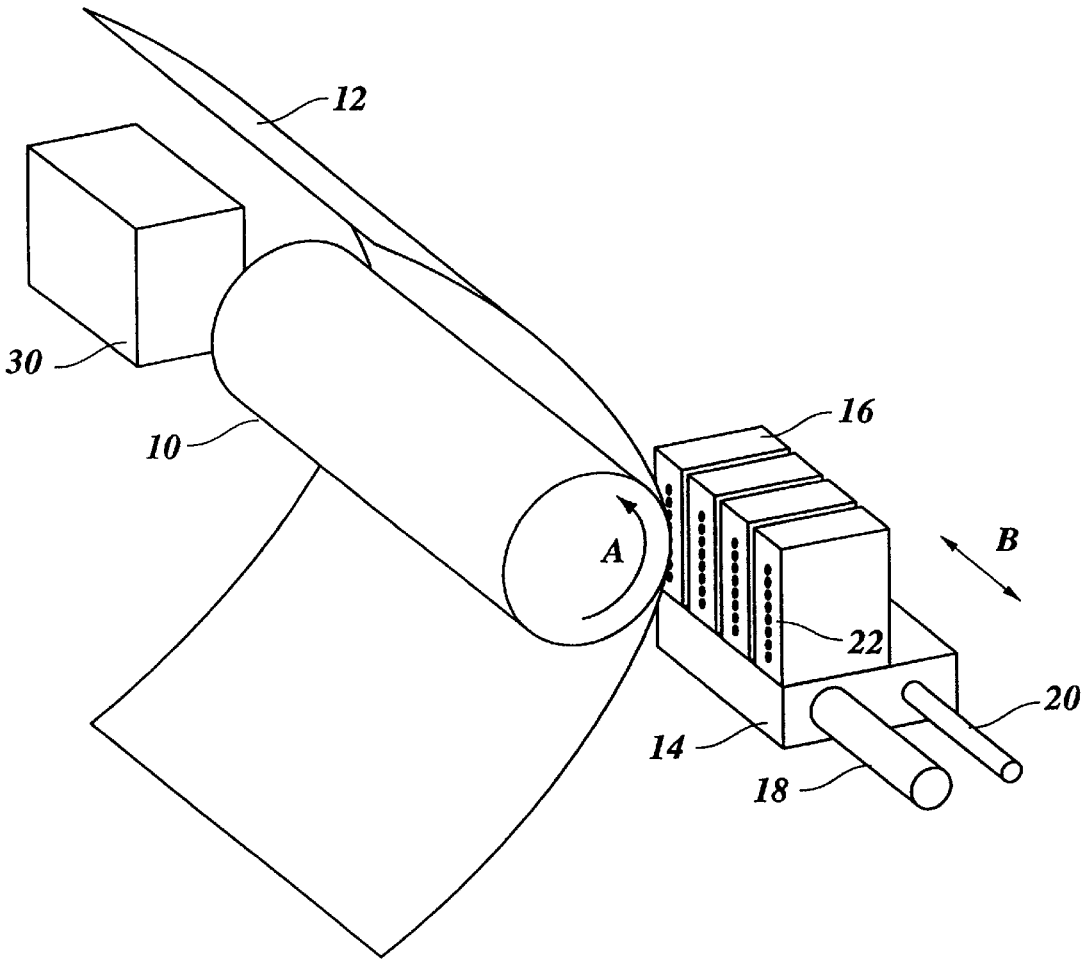
FIG. 1 is a schematic perspective view of the main components of an inkjet printer.

As is shown in FIG. 1, an ink jet printer comprises a platen 10 for supporting and feeding a sheet of paper 12 which forms an image receiving medium. The platen 10 is rotatable about its longitudinal axis as is indicated by an arrow A.

A carriage 14 carrying four printheads 16 for four different printing colors is movable back and forth in a direction indicated by arrows B parallel to the platen 10, so that the printheads 16 scan the paper 12 in line direction. The carriage 14 is guided on guide rods 18, 20 and is driven by suitable drive means (not shown) such as a cable or the like.

In the embodiment as shown, each printhead 16 has eight nozzles 22 which form a linear array extending normal to the line direction, i.e. in the circumferential direction of the platen 10. In a practical embodiment the number of nozzles per printhead may be considerably larger. Each nozzle 22 is associated with an actuator system which is arranged inside of the printhead 16 and is not shown in the drawing. Together with its associated actuator system each nozzle 22 forms a dot generating unit which can be energised to expel ink droplets onto the paper 12 so that dots are formed on the paper.

By means of the eight nozzles 22 per printing color is it possible to print eight lines on the paper 12 during each scan pass of the printheads 16 in the direction B.

Figure 2:
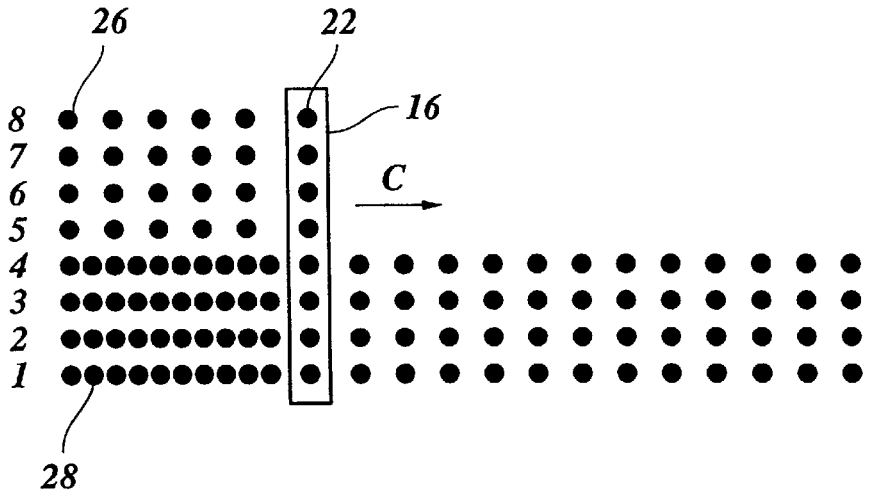
FIGS. 2–4 are diagrams illustrating the method according to the present invention.

The pattern in which the lines are printed under normal operating conditions of the printer will now be explained in conjunction with FIG. 2, where only one color component is considered and, accordingly, only one of printheads 16 is shown.

It shall be assumed that a two-pass system is employed. This means that all odd-numbered pixels or dots 26 of eight consecutive image lines are printed during a forward pass of the printhead 16, i.e. when the printhead 16 moves in the direction of an arrow C in FIG. 2, and all even-numbered dots 28 are printed during the return pass, i.e. when the printhead moves in the opposite direction. It is further assumed that the paper is fed downwardly in FIG. 2. The even-numbered dots 28 of the lower four lines 1–4 have been printed already in a previous scan cycle. In the current cycle, the printhead 16 is in the forward pass and prints the odd-numbered dots 26 of the eight lines 1–8, so that the lower four lines are completed and every second dot is printed in the upper four lines 5–8. At the end of the forward pass, when the printhead has reached the right end of the lines in FIG. 2, the paper will be fed over a distance corresponding to four lines. Thus, in the return pass, the printhead will complete the lines 5–8 and will commence the next four lines. Then, the paper is again fed by four lines, and the cycle is repeated.

Figure 3:
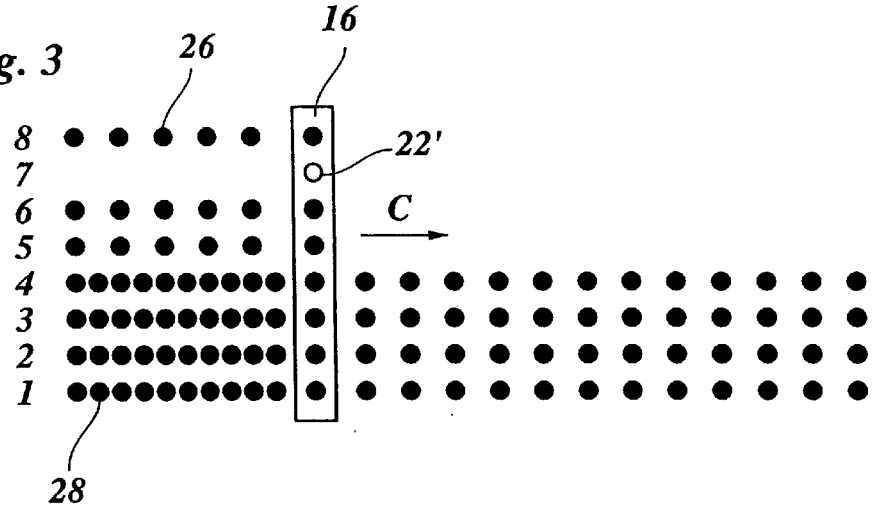

FIG. 3 illustrates the case wherein one of the eight nozzles, designated as 22', has become inoperative, for example because of an air bubble trapped in the actuator system. As a result, the odd-numbered dots 26 cannot be printed in line 7 during the forward pass of the printhead.

Figure 4:
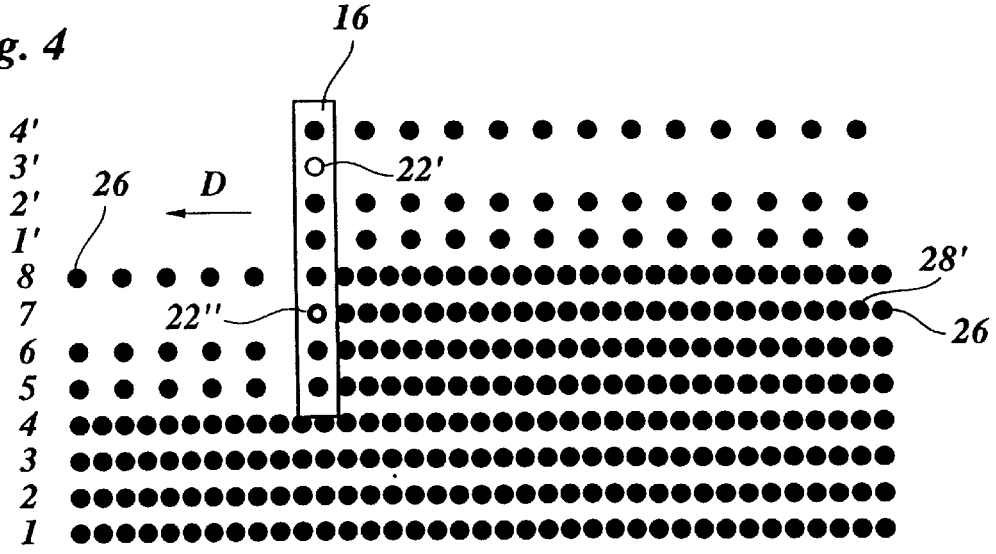

However, when the printhead performs the return pass in the direction of an arrow D in FIG. 4, another one of its nozzles, designated as 22", is in a position suitable for printing the line 7, and this nozzle is now driven to print not only the odd-numbered dots 26 but also the even-numbered dots 28'of this line. In other words, the nozzle 22"performs the task of the inoperative nozzle 22' in addition to its own task. In the next cycle, the nozzle 22" will also print the missing dots in line 3', which the nozzle 22' has failed to print in the present cycle.

Conversely, if the nozzle 22" were inoperative, its task would be fulfilled "in advance" by the nozzle 22'. Similarly, the remaining three pairs of nozzles of the printhead 16 which are respectively separated by a distance of four lines form partners which can mutually substitute their functions.

In the example shown in FIG. 4, the nozzle 22' must operate with twice the normal operating frequency, at least when a "black" area is to be printed, that is, when all dots of the line must actually be printed. In a practical embodiment, the normal operating frequency of the nozzles may be 10 kHz, and the printhead 16 may travel at a speed of 0.8 m/s. When the nozzle 22' fails, the nozzle 22" will operate at 20 kHz, and the scanning speed of the printhead 16 will be kept at 0.8 m/s.

While a two-pass system has been described above, the principle of the invention is also applicable to a multi-pass system with three or more passes. For example, in the case of a three-pass system, each nozzle that becomes inoperative has two partners which are capable of taking-over its function, so that the system would be even more robust. However the nozzles that take-over must be capable of operating with three times the normal operating speed, although they may share their task.

As is shown in FIG. 1, a detector 30 may be provided for checking in certain intervals, e.g. when the carriage 14 reaches a home position after a complete scan cycle, and whether all the nozzles 22 of all printheads 16 are still operative. When a failure of one of the nozzles is detected, the procedure illustrated in FIG. 4 is initiated automatically.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of compensating for the failure of a dot generating unit in printing system containing a multiple-unit printhead which scans scanning an image receiving medium in line direction and is capable of printing a plurality of lines (1–8) at one time, wherein multi-pass printing and interleaved line feed are employed, and wherein when a unit fails, the image information associated with that unit for each pass of the printhead is printed with at least one other unit of the printhead during at least one of the other passes, wherein when n is the number of passes per scan cycle,said at least one other unit which also prints the image information associated with the inoperative unit is operated with n times the operating frequency of the other units, and the printhead is moved in the scanning direction with the same speed as in the case where all of the units are operative.

2. The method according to claim 1 wherein two-pass printing is performed.

3. The method according to claim 1, wherein failure of a dot generating unit is detected automatically and the compensation procedure is initiated automatically in response to such detection.

* * * * *